US007261077B2

(12) United States Patent
Asano et al.

(10) Patent No.: US 7,261,077 B2
(45) Date of Patent: Aug. 28, 2007

(54) DECOMPRESSOR AND VEHICLE

(75) Inventors: Yuuichi Asano, Shizuoka (JP); Itsushi Hirukawa, Shizuoka (JP); Yasuhiro Okamoto, Shizuoka (JP)

(73) Assignee: Yamaha Hatsudoki Kabushiki Kaisha, Iwata-shi (JP)

( * ) Notice: Subject to any disclaimer, the term of this patent is extended or adjusted under 35 U.S.C. 154(b) by 103 days.

(21) Appl. No.: 11/278,697

(22) Filed: Apr. 5, 2006

(65) Prior Publication Data

US 2006/0225686 A1 Oct. 12, 2006

(30) Foreign Application Priority Data

Apr. 7, 2005 (JP) ..... 2005-111209

(51) Int. Cl.
*F01L 13/08* (2006.01)

(52) U.S. Cl. ..... 123/182.1

(58) Field of Classification Search ..... 123/182.1
See application file for complete search history.

(56) References Cited

U.S. PATENT DOCUMENTS 3,511,219 A * 5/1970 Esty ..... 123/182.1
5,816,208 A * 10/1998 Kimura ..... 123/182.1
6,250,271 B1 * 6/2001 Ikuma et al. ..... 123/182.1
6,543,403 B2 * 4/2003 Kawamoto ..... 123/182.1
2002/0157631 A1 * 10/2002 Kawamoto ..... 123/182.1
2004/0187825 A1 * 9/2004 Kurokawa et al. ..... 123/182.1
2006/0048736 A1 * 3/2006 Sugiura et al. ..... 123/182.1

FOREIGN PATENT DOCUMENTS

JP 2001-173421 A 6/2001

* cited by examiner

*Primary Examiner*—Andrew M. Dolinar
*Assistant Examiner*—Arnold Castro
(74) *Attorney, Agent, or Firm*—Keating & Bennett, LLP

(57) ABSTRACT

An engine decompressor includes a decompressor pin provided through a pin hole on the surface of a valve cam, a decompressor pin operating shaft in an oil passage provided in a valve cam shaft of the valve cam for vertically moving the decompressor pin by its rotation, a fly weight rotatable by rotation of the valve cam shaft so as to rotate the decompressor pin operating shaft, and a thrust receiving plate separate from the fly weight for restricting the axial movement of the decompressor pin operating shaft in the oil passage. The engine decompressor is capable of operating a decompressor mechanism normally even if the lubricating oil increases in pressure.

6 Claims, 9 Drawing Sheets

DECOMPRESSOR AND VEHICLE

BACKGROUND OF THE INVENTION

1. Field of the Invention

The present invention relates to a decompressor and a vehicle, and in particular, it relates to an improvement in a decompressor of the type having a decompressor pin operating shaft in an oil passage provided in a valve cam shaft.

2. Description of the Related Art

Decompressors of engines force exhaust valves to open slightly in the process of compression at engine start-up or at engine stopping, thereby reducing the cranking torque of the engine to improve engine start-up performance. In other words, the decompressor releases a portion of compressed gas from a combustion chamber by slightly opening exhaust valves in the process of compression, thereby reducing cranking torque. Also, the decompressor slightly opens exhaust valves to reduce cranking torque during engine starting. The provision of such a decompressor to an engine allows an engine starter motor to be decreased in size and a battery for driving the starter motor to be reduced in capacity.

The patent document JP-A-2001-173421 discloses a structure of an engine decompressor, in which a valve cam has a pin hole on the surface, through which a decompressor pin is provided. A decompressor pin operating shaft is disposed in an oil passage provided in a valve cam shaft. The decompressor pin moves vertically with the rotation of the decompressor pin operating shaft. The decompressor pin operating shaft is rotated by a fly weight that rotates against the biasing force of a return spring, according to the rotation speed of the valve cam shaft. With the decompressor, when the fly weight rotates as the rotation speed of the valve cam shaft increases, the decompressor pin, whose head projects to the surface of the valve cam during engine stopping, extends into the deep pin hole thus achieving the above described decompressing function.

The decompressor disclosed in JP-A-2001-173421 has a decompressor pin operating shaft in an oil passage, thus allowing a smooth decompressing operation in normal environments, so that it may be advantageous. However, under very low temperatures, the viscosity of lubricating oil becomes extremely high, and the pressure of the lubricating oil significantly increases. In that case, the decompressor pin operating shaft is pushed axially in the valve cam shaft to bring the end surface into contact with another member, thus preventing smooth rotation of the decompressor pin operating shaft. Particularly, the fly weight is journaled at its rim, and the biasing force of the return spring is a relatively small value to operate the fly weight normally at a low rotation speed. Accordingly, when the decompressor pin operating shaft is pushed strongly against the center of the fly weight, even the motion of the fly weight may be locked.

SUMMARY OF THE INVENTION

In order to overcome the problems described above, preferred embodiments of the present invention provide an engine decompressor capable of operating a decompressor mechanism normally even if lubricating oil increases in pressure, and also provide a vehicle including such a novel engine decompressor.

In order to solve the above problems, an engine decompressor according to a preferred embodiment of the present invention includes a decompressor pin provided through a pin hole on a surface of a valve cam, a decompressor pin operating shaft provided through an oil passage provided in the valve cam shaft of the valve cam for vertically moving the decompressor pin by its rotation, a fly weight rotatable with the rotation of the valve cam shaft so as to rotate the decompressor pin operating shaft, and a restricting member separate from the fly weight and arranged to restrict the axial movement of the decompressor pin operating shaft in the oil passage.

According to the present preferred embodiment, a restricting member separate from the fly weight is provided to limit the axial movement of the decompressor pin operating shaft. Accordingly, even if the pressure of the lubricating oil increases, the decompressor mechanism can be operated normally.

According to another preferred embodiment of the invention, the restricting member is disposed between the fly weight and the decompressor pin operating shaft, and prevents the end surface of the decompressor pin operating shaft from coming into contact with the fly weight. This structure can reliably prevent the decompressor pin operating shaft from pushing the fly weight and locking the motion of the fly weight.

According to another preferred embodiment of the present invention, the restricting member is a plate that is in contact with one end of the decompressor pin operating shaft. This provides a decompressor mechanism that can operate normally even if the pressure of the lubricating oil increases with a compact structure that is easy to manufacture and mount.

In this case, the restricting member may have a projection that is in contact with the axial center of the decompressor pin operating shaft at the end of the decompressor pin operating shaft. This structure can reduce the friction between the decompressor pin operating shaft and the restricting member.

According to another preferred embodiment of the present invention, the fly weight is separate from a sprocket for rotating the valve cam shaft, and the sprocket is mountable to the decompressor pin operating shaft after the fly weight is mounted to the valve cam shaft. Thus, the decompressor mechanism can be assembled independently from the assembly of the cam chain and the sprocket. This can prevent assembly problems and improve productivity.

A vehicle according to another preferred embodiment of the present invention includes one of the above described decompressors. This can provide vehicles with a reliable decompressor mechanism. The vehicles may preferably include saddle-type vehicles and compact four wheel vehicles. The saddle-type vehicles include motor-bicycles (including motorbikes and motor scooters), four wheel buggies (all terrain vehicles), and snowmobiles. The compact four wheel vehicles include two seater or four seater four wheel buggies (all terrain vehicles).

Other features, elements, steps, characteristics and advantages of the present invention will become more apparent from the following detailed description of preferred embodiments of the present invention with reference to the attached drawings.

DETAILED DESCRIPTION OF PREFERRED EMBODIMENTS

The present invention is described in detail below based on preferred embodiments, with reference to the attached drawings.

Figure 1:
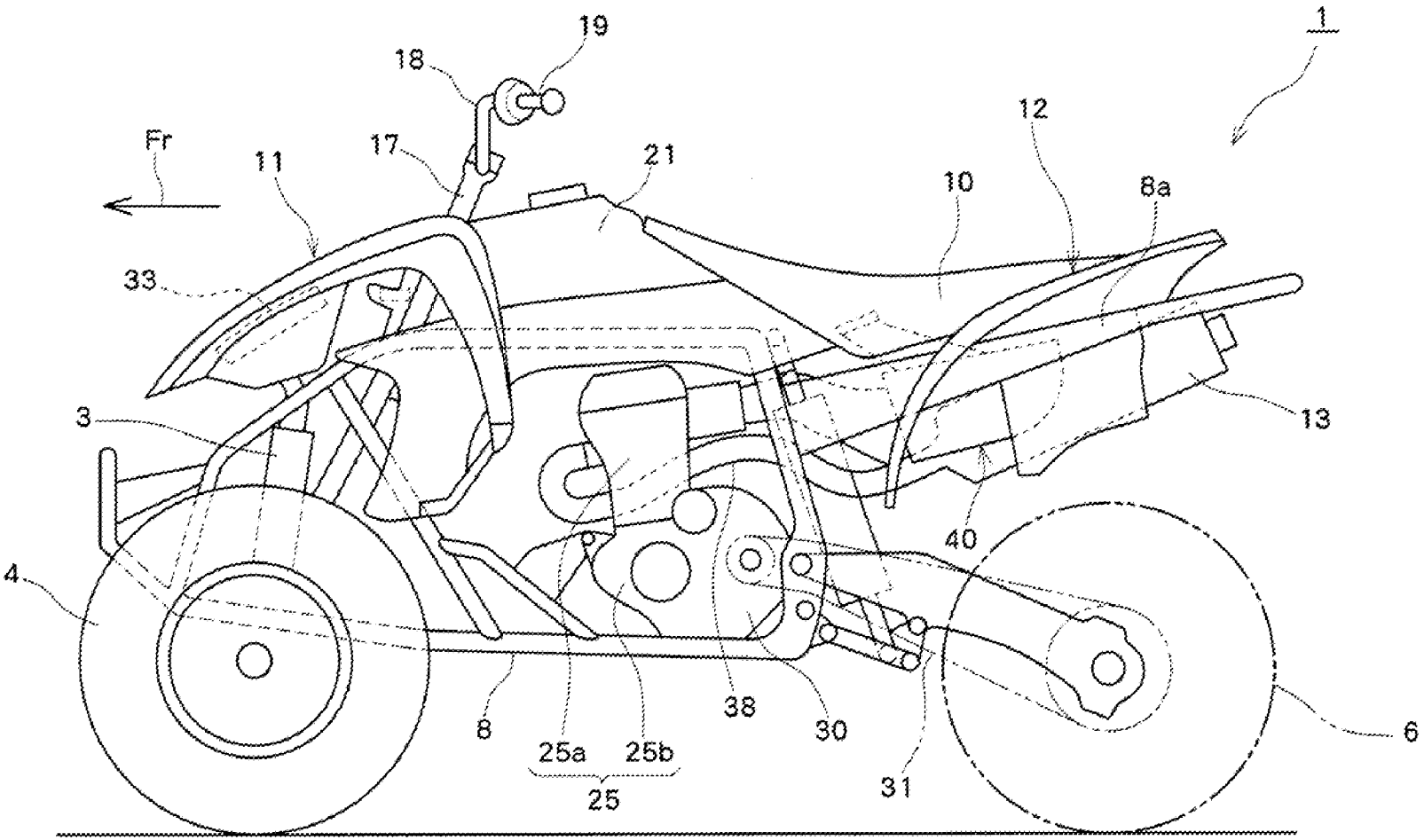
FIG. 1 is an external side view of a saddle-type vehicle according to a preferred embodiment of the invention.

FIG. 1 is a side view of a saddle-type vehicle (all terrain vehicle) according to a preferred embodiment of the present invention. As shown in the drawing, a vehicle 1 has front suspensions 3 and 3 on the right and left of the vehicle at the front in the direction of travel (indicated by arrow Fr in the drawing), and front wheels 4 and 4 journaled at the lower ends. Front fenders 11 and 11 are disposed above the front wheels 4 and 4. The upper ends of the front suspensions 3 and 3 are supported by a body frame 8. The front end of the body frame 8 in the traveling direction journals a steering shaft 17 such that the front end can be turned to the right and left. At the upper end of the steering shaft 17, a handle 18 extending to the right and left is supported at the center thereof. Grips 19 and 19 are provided on both ends of the handle 18. The right grip 19 has an accelerator which is operated by the pressure of a driver's fingers during driving. A radiator 33 is provided ahead of the steering shaft 17. The radiator 33 circulates cooling water in the radiator 33 to cool the cooling water with air passing from the front, thereby releasing heat generated from an engine 25. An intake system 40 including an intake pipe and an air cleaner is connected to the rear of the engine 25, and an exhaust pipe 38 is connected to the front of the engine 25. The exhaust pipe 38 extends forward from the engine 25 and is then bent in a U-shape toward the rear in the traveling direction. The rear end of the exhaust pipe 38 connects to a muffler 13. Exhaust gas discharged from the engine 25 circulates through the exhaust pipe 38, and is then discharged from the rear of the muffler 13. The engine 25 includes an internal combustion engine 25*a* and a crank 25*b* disposed under the internal combustion engine. Driving force output from the engine 25 is transmitted through a transmission 30 and a chain mechanism 31 to rear wheels 6 and 6. Rear fenders 12 and 12 are disposed on the right and left above the rear wheels 6 and 6. The engine 25 is suspended by the body frame 8 at the upper portion thereof, and supported at the lower portion thereof.

The body frame 8 includes right and left frames that are joined together at the front ends. The frames extend from the front to the rear in the traveling direction at the lower portion of the vehicle 1, and are bent upward at the center of the vehicle 1. The frames include right and left seat frames 8*a*, with which a seat 10 is supported. In front of the seat 10 is disposed a fuel tank 21. The fuel tank 21 is supported by the body frame 8.

Figure 2:
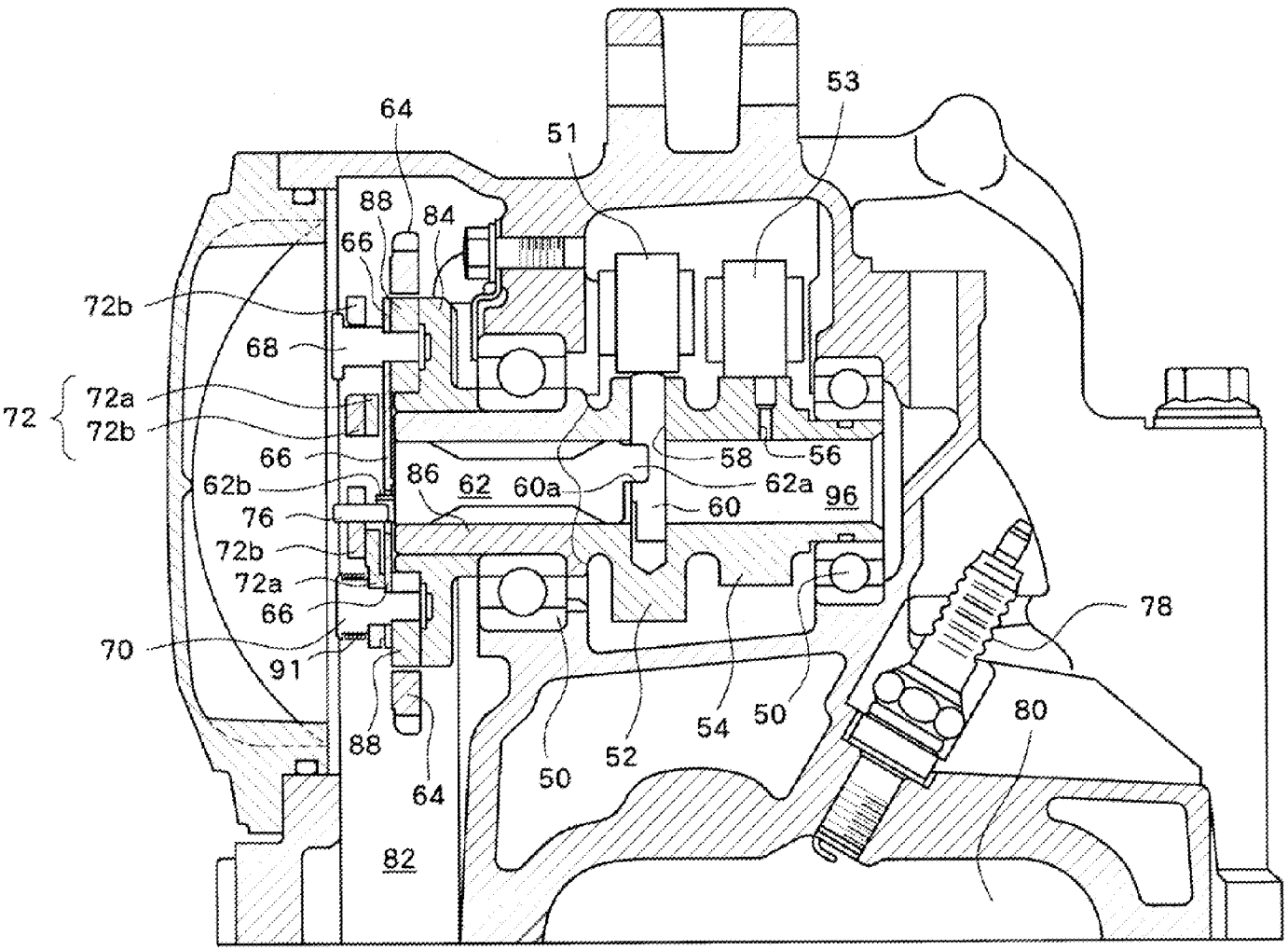
FIG. 2 is a cross-sectional view of a cylinder head having a decompressor according to a preferred embodiment of the invention in FIG. 1.
Figure 3:
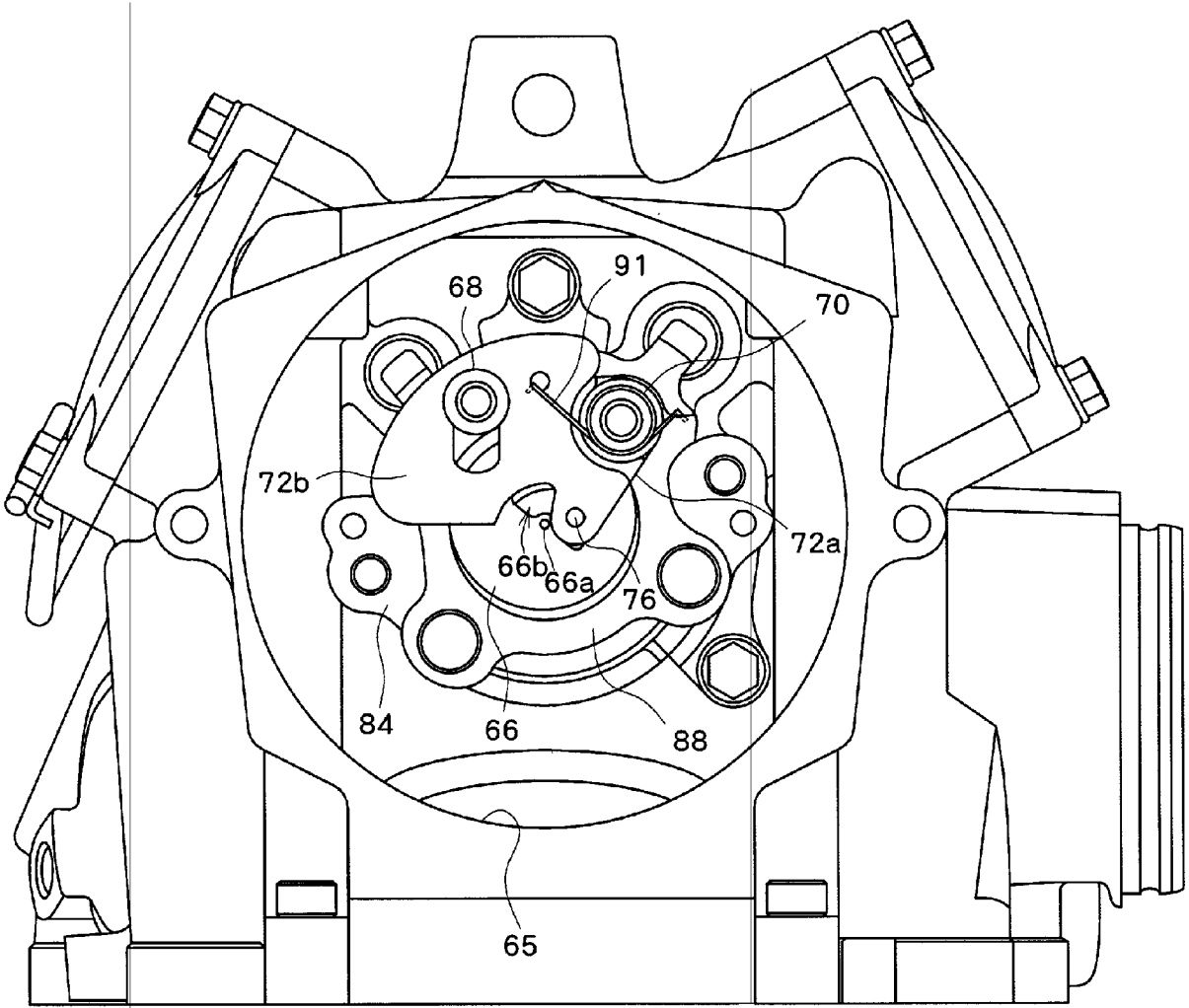
FIG. 3 is a side view of the cylinder head, as viewed from a cam chain chamber.
Figure 4:
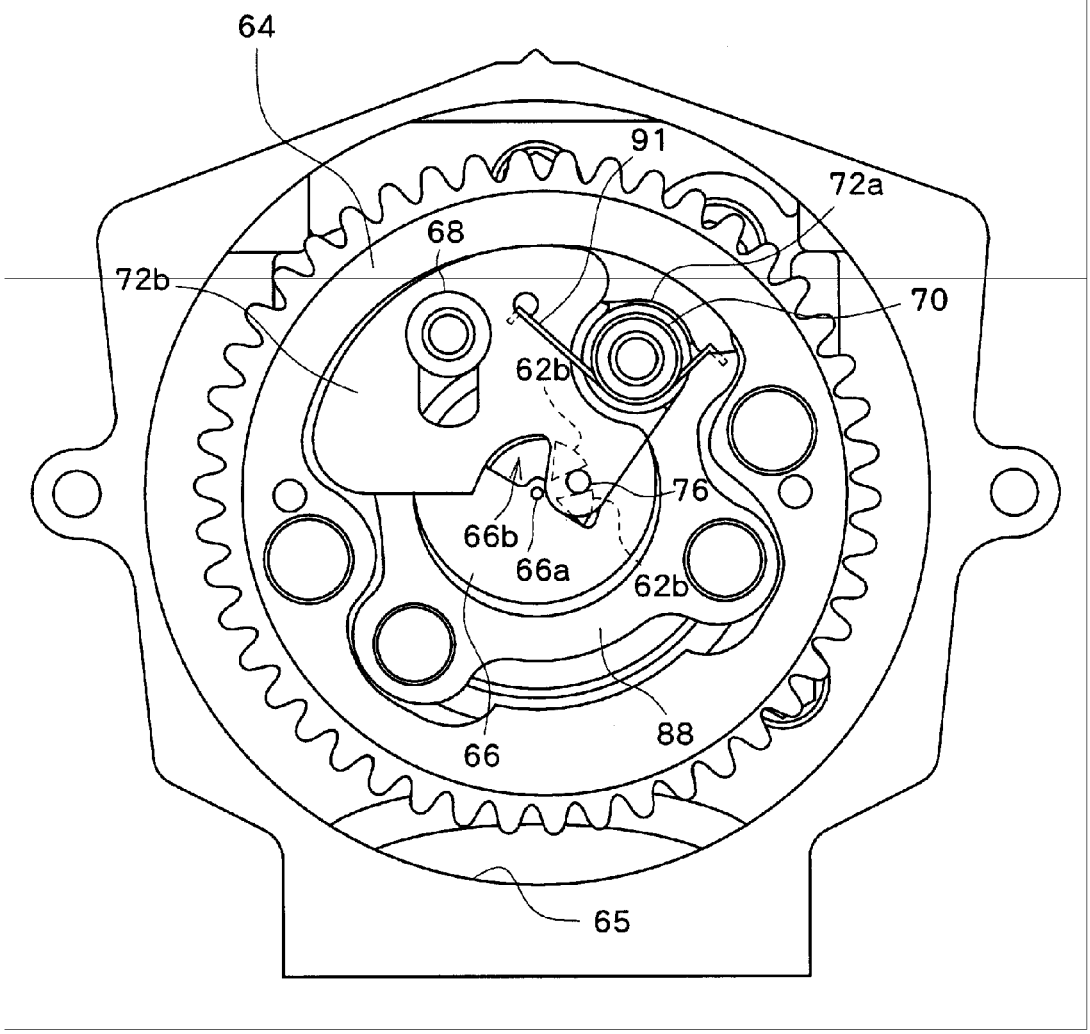
FIG. 4 is an enlarged side view of the cylinder head to which a sprocket is mounted, as viewed from the cam chain chamber.

A decompressor mounted to the engine 25 of the vehicle 1 will be specifically described hereinbelow. FIG. 2 is a cross-sectional view of the cylinder head of the engine 25, as viewed from a direction that is perpendicular to the valve cam shaft. FIG. 3 is a side view of the cylinder head of the engine 25 without the cover of the cam chain chamber and the sprocket, as viewed from the cam chain chamber. FIG. 4 is an enlarged side view of the cylinder head of the engine 25 equipped with a sprocket, as viewed from the cam chain chamber.

Figure 5:
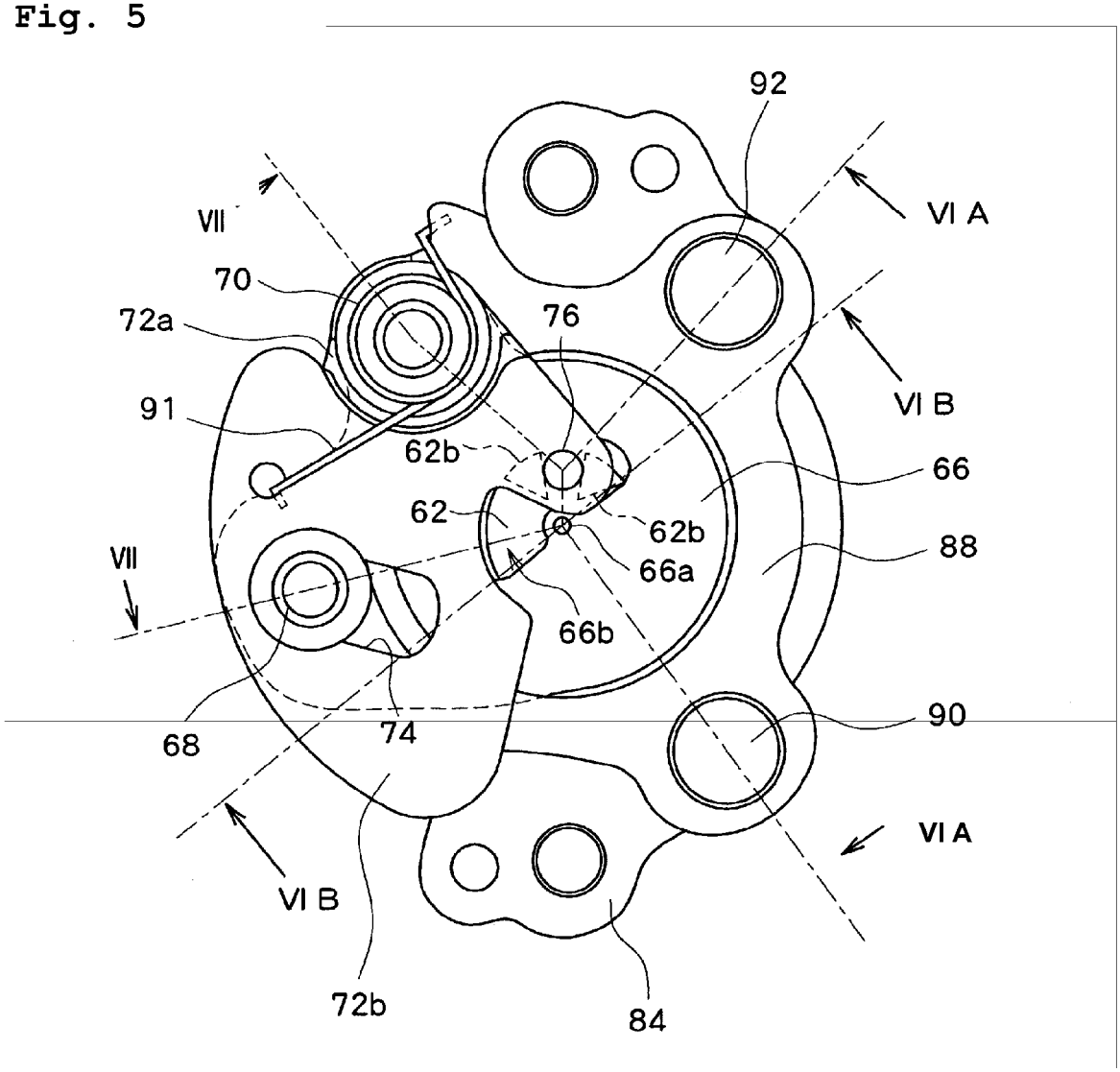
FIG. 5 is a diagram of a valve cam shaft to which a fly weight is mounted, as viewed from the shaft.
Figure 6:
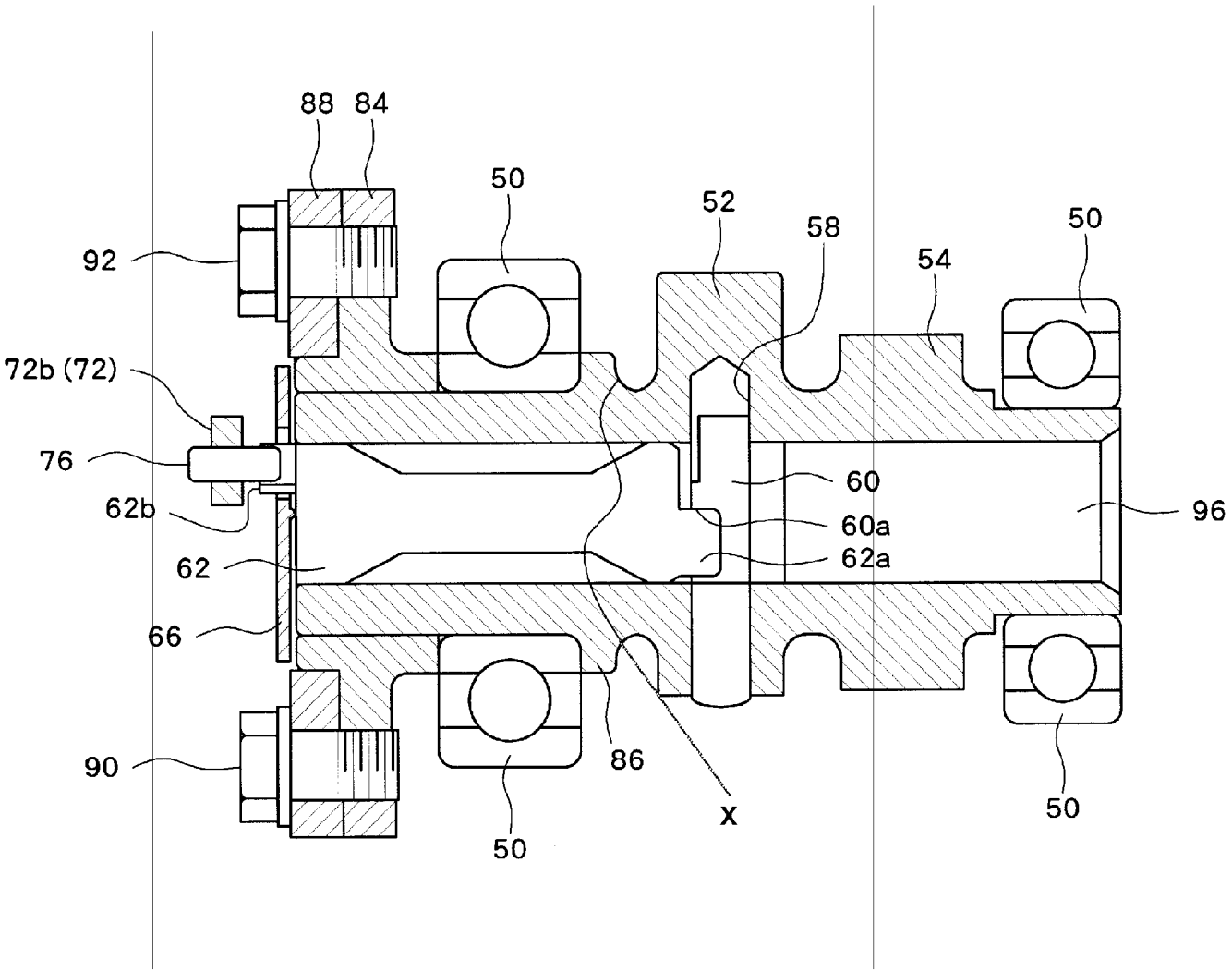
FIG. 6 is an enlarged cross-sectional view of the valve cam shaft, as viewed from the side.
Figure 7:
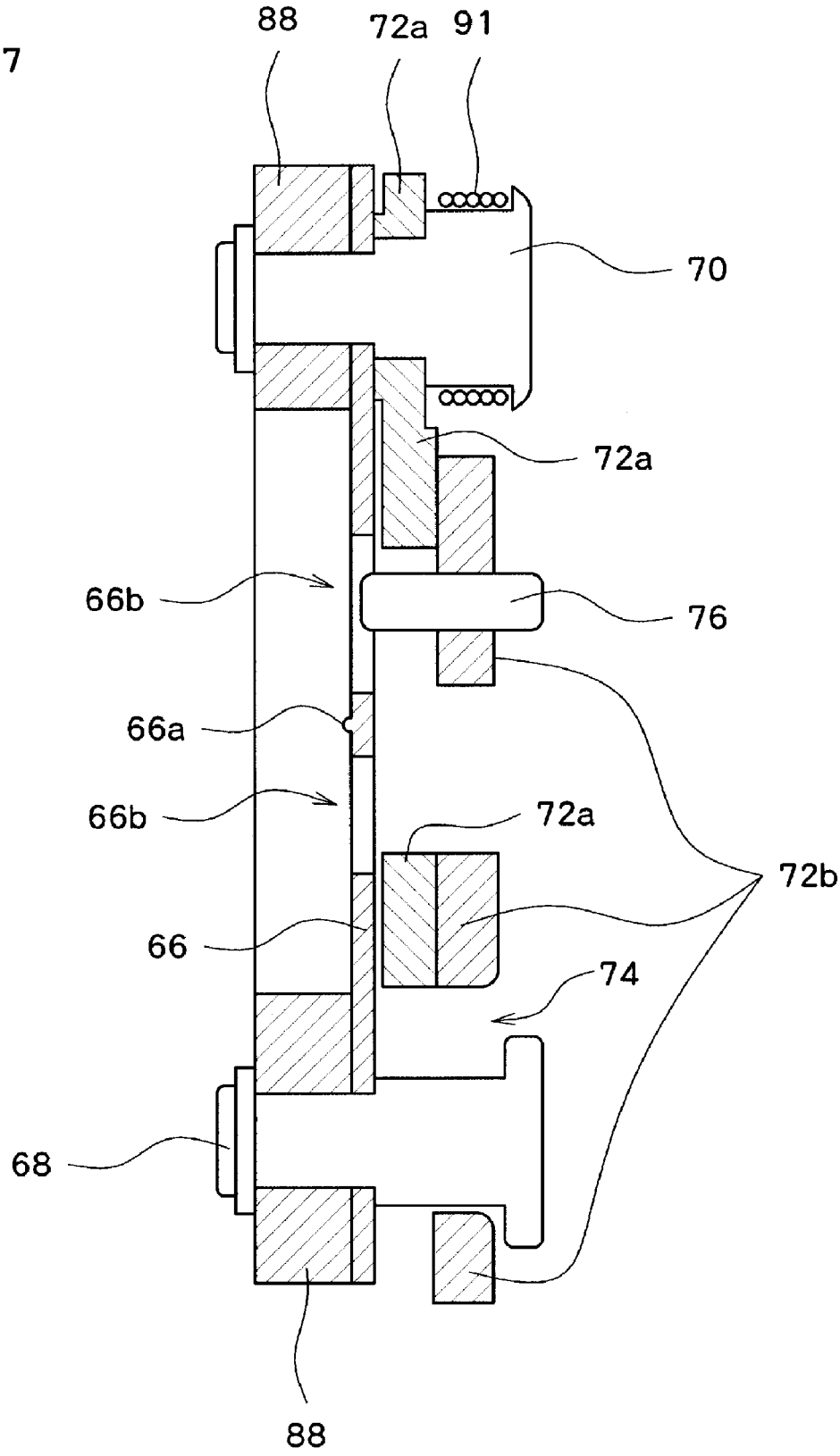
FIG. 7 is an enlarged cross-sectional view principally showing the fly weight.

FIG. 5 is a plan view of a decompressor assembly. FIG. 6 is a cross-sectional view of a valve cam shaft assembly in which the decompressor according to the present preferred embodiment is combined, wherein the left of break line X is a cross-sectional view taken along line VIA—VIA of FIG. 5, as viewed along the arrow; the right of break line X is a cross-sectional view taken along line VIB—VIB of FIG. 5, as viewed along the arrow. FIG. 7 is a cross-sectional view taken long line VII—VII of FIG. 5, as viewed along the arrow.

In the drawings, a valve cam shaft 86 journaled by bearings 50 and 50 is disposed above a combustion chamber 80 where a gas mixture is ignited by a spark plug 78. In the axial middle of the valve cam shaft 86, an exhaust valve cam 52 and an intake valve cam 54 are provided. The torque of a crankshaft (not shown) is transmitted to the valve cam shaft 86 through a sprocket 64 and a chain (not shown) routed around the sprocket 64, whereby the valve cams 52 and 54 lift up rocker arms 51 and 53 at the appropriate times. The rocker arms 51 and 53 connect to an exhaust valve and an intake valve (not shown), so that the valves can be opened or closed with the stroke of the engine.

The valve cam 52 that activates the exhaust valve has a pin hole 58 in which a decompressor pin 60 is accommodated. The axial center of the valve cam shaft 86 is hollow, which serves as an oil passage 96 for lubricating oil. The valve cam 54 also has an oil passage 56. The oil passage 56 communicates with the oil passage 96. Thus, the lubricating oil circulating in the oil passage 96 can be supplied to the surface of the valve cam 54. Although not shown, the valve cam 52 also has an oil passage that communicates with the oil passage 96, allowing the valve cam 52 to be supplied with lubricating oil.

A decompressor pin operating shaft 62 passes through a portion of the oil passage 96 adjacent to a cam chain chamber 82. The decompressor pin operating shaft 62 includes a cylinder that is smaller in diameter than the oil passage 96 and sandwiched between opposite ends having the same diameter as that of the oil passage 96. One end of the decompressor pin operating shaft 62 has an engaging pin 62*a* projecting from a position remote from an axial center of the decompressor pin operating shaft 62. The engaging pin 62*a* is in engagement with a recess 60*a* provided in the axial middle of the decompressor pin 60. Accordingly, when the decompressor pin operating shaft 62 rotates in the oil passage 96, the decompressor pin 60 moves vertically in the pin hole 58. Thus, decompression in which the head of the decompressor pin 60 projects from the pin hole 58 and non-decompression in which the head is completely accommodated in the depth of the pin hole 58, can be achieved by the rotation of the decompressor pin operating shaft 62.

Figure 8:
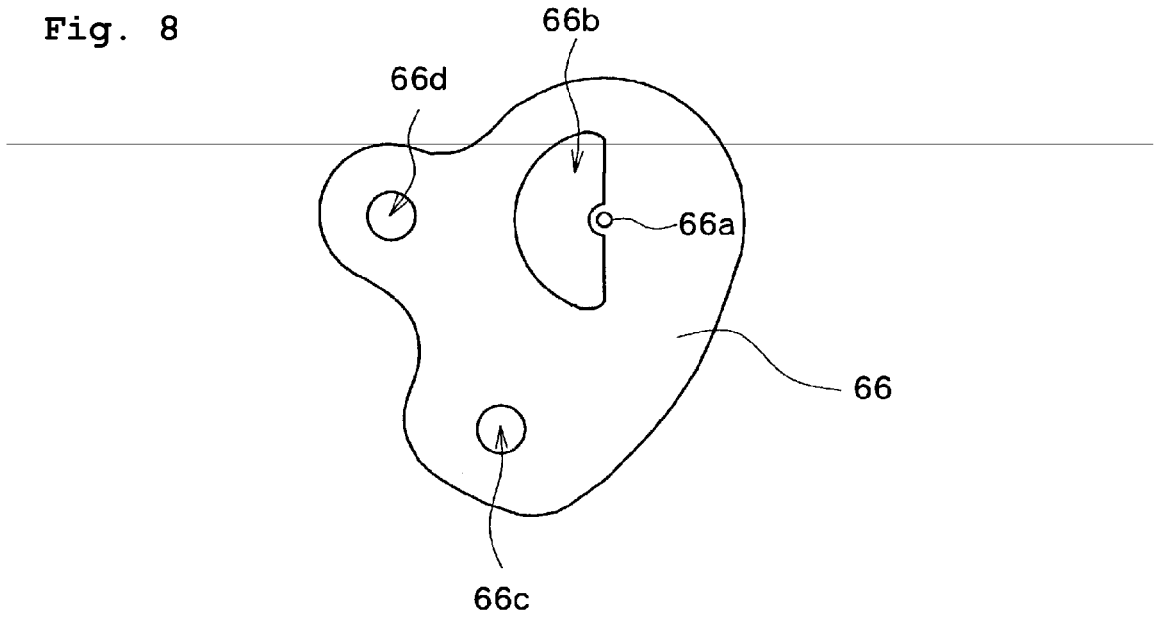
FIG. 8 is a plan view of a thrust receiving plate.
Figure 9:
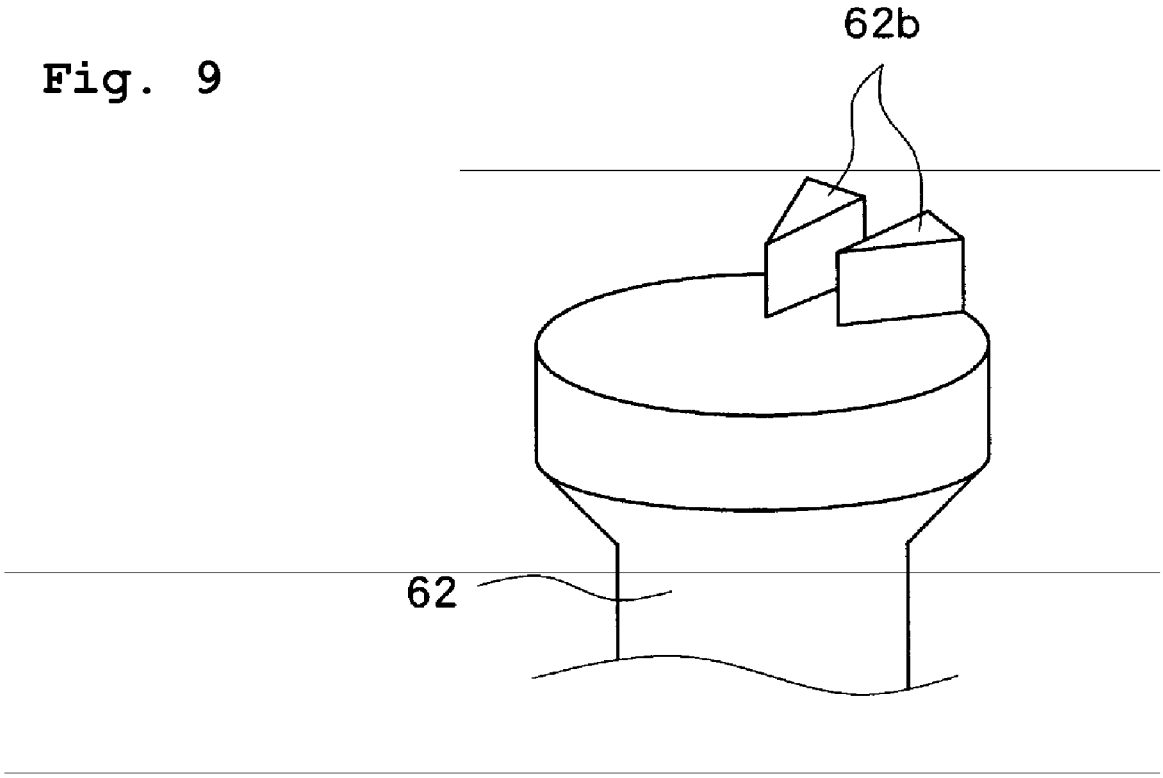
FIG. 9 is an enlarged perspective view of an end of a decompressor pin operating shaft.

A flange 84 is press-fitted in the end of the valve cam shaft 86 adjacent to the cam chain chamber 82. The flange 84 rotates together with the valve cam shaft 86. A plate 88 having an opening in the center is fixed to the flange 84. To the opening of the plate 88, a thrust receiving plate 66 is fixed with a rotation shaft 70 and a stopper pin 68. FIG. 8 is a plan view of the thrust receiving plate 66. As shown in FIG. 8, the thrust receiving plate 66 has a semicircular opening 66*b* in the center. The center of the linear rim of the semicircular opening 66*b* is enlarged toward the semicircular opening 66*b*, at which a projection 66*a* is provided. The projection 66*a* projects to the back of the thrust receiving plate 66 (toward the decompressor pin operating shaft 62), so that the projection 66*a* is in contact with the center of the end surface of the decompressor pin operating shaft 62 (a position through which the axial center of the decompressor pin operating shaft 62 passes) with the thrust receiving plate 66 mounted to the decompressor assembly. A pair of engaging projections 62*b* arranged at the end surface of the decompressor pin operating shaft 62 extends through a portion of the opening 66*b* located on the side of the projection 66*a* extending toward the cam chain chamber 82. FIG. 9 is a perspective view of the engaging projections 62*b* arranged at the end of the decompressor pin operating shaft 62. As shown in FIG. 9, most of the end surface of the decompressor pin operating shaft 62 is in a plane that is substantially perpendicular to the axis of the decompressor pin operating shaft 62, from which plane the pair of engaging projections 62*b* extend. Between the pair of engaging projections 62*b*, a parallel space is formed, in which an operating shaft rotating pin 76 of a fly weight 72, to be described later, is located. Referring back to FIG. 8, the thrust receiving plate 66 has openings 66*c* and 66*d* arranged at the rim. The opening 66*c* allows the stopper pin 68 to pass through and the opening 66*d* allows the rotation shaft 70 to pass through. As shown in FIG. 7, the stopper pin 68 and the rotation shaft 70 increase in diameter in a step-shape at a specified length from the ends. The thrust receiving plate 66 is pushed and fixed to the plate 88 at the step-shape portion.

In other words, the ends of the rotation shaft 70 for journaling the flyweight 72 and the stopper pin 68 are press-fitted into the plate 88 and fixed by caulking, or the like. The flyweight 72 includes a planar first fly weight plate 72*a* and a second fly weight plate 72*b*. The second fly weight plate 72*b* has an opening 74, through which the stopper pin 68 passes. The stopper pin 68 also passes through the thrust receiving plate 66. The end of the stopper pin 68 is press-fitted into the plate 88 and is fixed by caulking, or the like. Thus, the thrust receiving plate 66 is fixed to the plate 88 and the movable range of the fly weight 72 is limited. The fly weight 72 is biased to the axial center of the valve cam shaft 86 by a return spring 91 fixed to the rotation shaft 70. Particularly, the operating shaft rotating pin 76 extends from the rim of the second fly weight plate 72*b* corresponding to the opening 66*b* of the thrust receiving plate 66 and extends to the decompressor pin operating shaft 62. The operating shaft rotating pin 76 is located between the pair of engaging projections 62*b* provided on the end surface of the decompressor pin operating shaft 62, as described above. Accordingly, when the fly weight 72 rotates (angles) in the direction separating from the axial center of the valve cam shaft 86 against the biasing force of the return spring 91 with the rotation of the valve cam shaft 86, the side of the operating shaft rotating pin 76 is brought into contact with the side of the engaging projections 62*b*, thereby applying torque to the decompressor pin operating shaft 62.

As shown in FIGS. 3 and 4, the sprocket 64 is fixed to the flange 84 with bolts, and the flange 84 is fixed to the plate 88 with bolts 90 and 92. The sprocket 64 is exposed by the opening 65 on the side of the cam chain chamber 82. Thus the sprocket 64 can be easily mounted or dismounted by removing a cover.

With this structure, the projection 66*a* of the thrust receiving plate 66 comes in contact with the end surface of the decompressor pin operating shaft 62 at the axial center. Thus the friction between the thrust receiving plate 66 and the decompressor pin operating shaft 62 can be extremely small. Accordingly, even if the viscosity of the oil in the oil passage 96 increases due to very low temperatures so that the decompressor pin operating shaft 62 is pushed strongly toward the cam chain chamber 82, the decompressor pin operating shaft 62 can be smoothly rotated in the oil passage 96, allowing normal decompression.

Since the thrust receiving plate 66 has the opening 66*b* beside the projection 66*a* through which the operating shaft rotating pin 76 of the fly weight 72 and the engaging projections 62*b* of the decompressor pin operating shaft 62 are brought into engagement with each other, the decompressor pin operating shaft 62 is surely prevented from pushing the fly weight 72 in the direction of its axis. This prevents locking of the motion of the fly weight 72.

The sprocket 64 in engagement with the cam chain and the fly weight 72 are separately constructed. The center of the sprocket 64 has a large opening so that after the entire decompressor mechanism including the fly weight 72 is attached to the engine 25, the sprocket 64 can be mounted to the engine 25. This prevents a decompressor mechanism mount failure when the sprocket 64 is integral with the fly weight 72, thereby improving the reliability of the decompressor mechanism.

The present invention is not limited to the above preferred embodiments. Although an example applicable to a four wheel saddle-type vehicle has been described, the present invention may also be applied to two wheel or three wheel saddle-type vehicles. Also, the present invention may be applied to general vehicles of various sizes.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. An engine decompressor comprising:

a valve cam including a pin hole on a surface of the valve cam, and a valve cam shaft having a hole;

a decompressor pin provided through the pin hole on the surface of the valve cam;

a decompressor pin operating shaft provided in the hole of the valve cam shaft such that rotation of the valve cam shaft vertically moves the decompressor pin;

a fly weight rotatable by rotation of the valve cam shaft so as to rotate the decompressor pin operating shaft; and a restricting member separate from the fly weight and arranged to prevent the decompressor pin operating shaft in the hole from coming into contact with the fly weight.

2. The engine decompressor according to claim 1, wherein the restricting member is disposed between the fly weight and the decompressor pin operating shaft.

3. The engine decompressor according to claim 1, wherein the restricting member has a portion that is in contact with one end of the decompressor pin operating shaft.

4. The engine decompressor according to claim 3, wherein the restricting member has a portion that is in contact with the axial center of the decompressor pin operating shaft at the end of the decompressor pin operating shaft.

5. The engine decompressor according to claim 1, further including a sprocket arranged to rotate the valve cam shaft, wherein the fly weight is separate from the sprocket, the sprocket and fly weight being arranged such that the sprocket is mountable to the decompressor pin operating shaft after the fly weight is mounted to the valve cam shaft.

6. A vehicle comprising the engine decompressor according to claim 1.

* * * * *